US008869660B2

(12) United States Patent
Hsieh

(10) Patent No.: US 8,869,660 B2
(45) Date of Patent: Oct. 28, 2014

(54) CLAMPING STRUCTURE FOR A TOOL

(75) Inventor: Chih-Ching Hsieh, Taichung (TW)

(73) Assignee: Kabo Tool Company, Taichung (TW)

( * ) Notice: Subject to any disclaimer, the term of this patent is extended or adjusted under 35 U.S.C. 154(b) by 233 days.

(21) Appl. No.: 13/603,394

(22) Filed: Sep. 4, 2012

(65) Prior Publication Data

US 2013/0220085 A1 Aug. 29, 2013

(30) Foreign Application Priority Data

Feb. 23, 2012 (TW) ..... 101203308 U

(51) Int. Cl.
*B25B 13/06* (2006.01)
*B25B 13/08* (2006.01)

(52) U.S. Cl.
USPC ..... 81/186; 81/119

(58) Field of Classification Search
USPC ..... 81/186, 121.1, 119
See application file for complete search history.

(56) References Cited

U.S. PATENT DOCUMENTS

| | | | | |
|---|---|---|---|---|
| 5,284,073 | A * | 2/1994 | Wright et al. | 81/121.1 |
| 5,878,636 | A * | 3/1999 | Baker | 81/119 |
| 5,992,271 | A * | 11/1999 | Mehlau et al. | 81/119 |
| 6,082,228 | A * | 7/2000 | Macor | 81/119 |
| 6,131,493 | A * | 10/2000 | Yamamoto et al. | 81/124.7 |
| 6,263,769 | B1 * | 7/2001 | Macor | 81/119 |
| 6,267,028 | B1 * | 7/2001 | Macor | 81/119 |
| 6,354,175 | B1 * | 3/2002 | Dobson et al. | 81/119 |
| 7,661,339 | B2 * | 2/2010 | Wu | 81/186 |
| 2006/0156869 | A1 * | 7/2006 | Hsieh | 81/121.1 |

* cited by examiner

*Primary Examiner* — David B Thomas
(74) *Attorney, Agent, or Firm* — CKC & Partners Co., Ltd.

(57) ABSTRACT

A clamping structure for a tool is provided. The clamping structure includes a plurality of grooves and an inner surface. The inner surface includes two inclined planes. Two convex arcs are connected to the inclined planes. Two concave arcs are connected to the inclined planes, and a middle salient connects one of the concave arcs to the other of the concave arcs. Wherein, an angle between a hypothesized extension line of one of the inclined planes and a hypothesized central line of one of the grooves is 40 degrees-50 degrees. Whereby, the clamping structure is easy to grip a damaged bolt or a damaged nut.

8 Claims, 8 Drawing Sheets

CLAMPING STRUCTURE FOR A TOOL

RELATED APPLICATIONS

The application claims priority to Taiwan Application Serial Number 101203308, filed Feb. 23, 2012, which is herein incorporated by reference.

BACKGROUND

1. Technical Field

The present disclosure relates to a tool. More particularly, the present disclosure relates to a clamping structure for a tool.

2. Description of Related Art

A wrench or a socket is a common tool. A clamping structure of the wrench or the tool may clamp one end of a bolt or a nut for rotation. Moreover, the clamping structure is a major part of a wrench or a socket to rotate the bolt or the nut.

The clamping structure of the wrench usually has several teeth for gripping the bolt or the nut. In general, the teeth of the wrench can grip the bolt or the nut tightly, so that the bolt or the nut can be rotated smoothly. However, since each tooth is small and sharp, a side surface of the bolt or the nut is easily to be damaged.

Moreover, after being damaged, the bolt or the nut may have few actual resistant regions against the wrench, and thus only one of the teeth of the damping structure can rotationally displace the damaged bolt or the damaged nut.

SUMMARY

An aspect of the present disclosure is to provide a clamping structure for a wrench or a socket. According to one embodiment of the present disclosure, the clamping structure is located in an offset ring of the wrench, and the clamping structure includes a plurality of grooves and an inner surface. Each of the grooves is disposed equidistantly in the offset ring. The inner surface is located between the two grooves, and the inner surface comprises two inclined planes, two convex arcs, two concave arcs and a middle salient, in an order from the grooves to the central of the inner surface. Each inclined plane has an angle, and the angle between a hypothesized extension line of one of the inclined planes and a hypothesized central line of one of the grooves is 40 degrees-50 degrees. The convex arcs are connected to the inclined planes, and the concave arcs are connected to the inclined planes. The middle salient connects one of the concave arcs to the other of the concave arcs.

According to another embodiment of the present disclosure, each of the two convex arcs has a top point, and a distance between the two top points is one half of a length of the inner surface. Wherein, the angle between the hypothesized extension line of the one of the inclined planes and the hypothesized central line of the one of the grooves is 44 degrees-46 degrees or 45 degrees.

It is to be understood that both the foregoing general description and the following detailed description are by examples, and are intended to provide further explanation of the invention as claimed.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
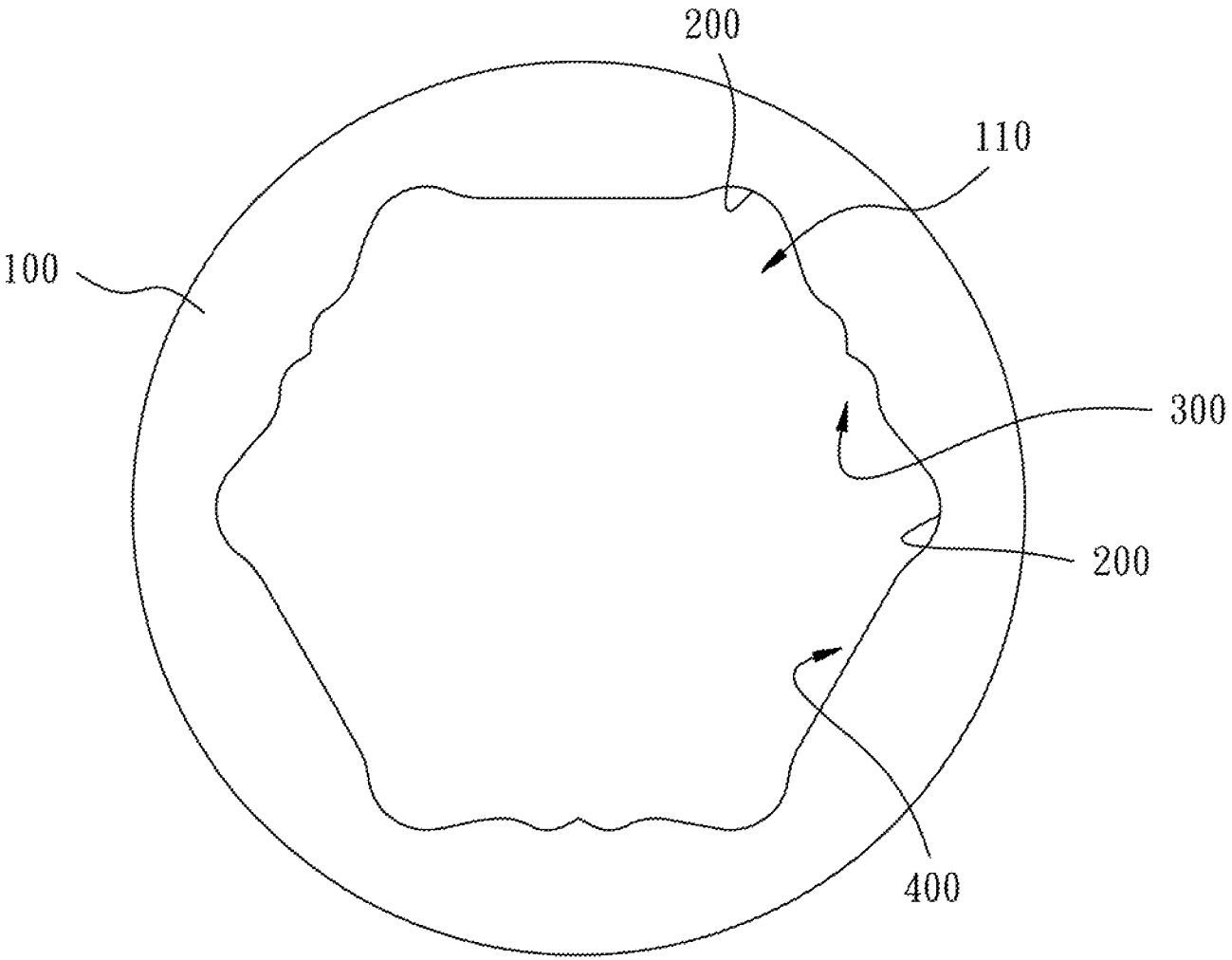
FIG. 1 illustrates a top view of a clamping structure for a tool according to one embodiment of the present disclosure.
Figure 2:
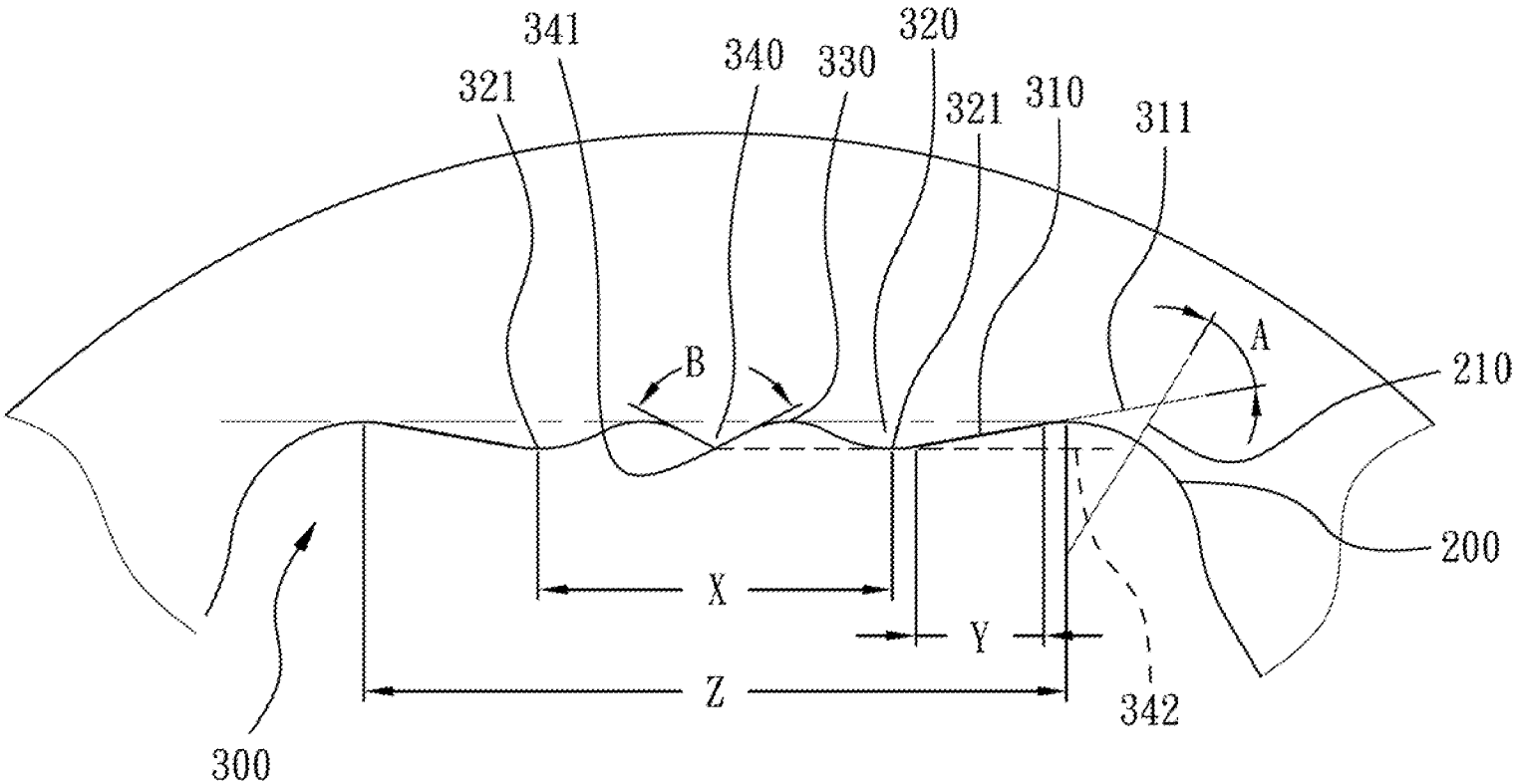
FIG. 2 is a partial view of the clamping structure of FIG. 1.

FIG. 1 illustrates a top view of a clamping structure for a wrench according to one embodiment of the present disclosure; FIG. 2 is a partial view of the clamping structure of FIG. 1.

The clamping structure is located in a hexagonal offset ring 110 of the wrench 100. The clamping structure includes six grooves 200, three inner surfaces 300 and three contact surfaces 400. The inner surfaces 300 are located non-adjacently and the contact surfaces 400 are located non-adjacently as well. Each of the grooves 200 is located in the offset ring 110 and the grooves 200 are spaced equidistantly. Each inner surface 300 is located between two grooves 200, and the inner surface 300 comprises two inclined planes 310, two convex arcs 320, two concave arcs 330 and a middle salient 340, in an order from the grooves 200 to the center of the inner surface 300. Each inclined plane 310 has an angle A between a hypothesized extension line 311 of one of the inclined planes 310 and a hypothesized central line 210 of one of the grooves 200 and the angle A is 40 degrees-50 degrees. The convex arc 320 connected to the inclined plane 310, and the concave arc 330 is connected to the inclined plane 310. The middle salient 340 connects one of the concave arcs 330 to the other of the concave arcs 330.

Figure 3:
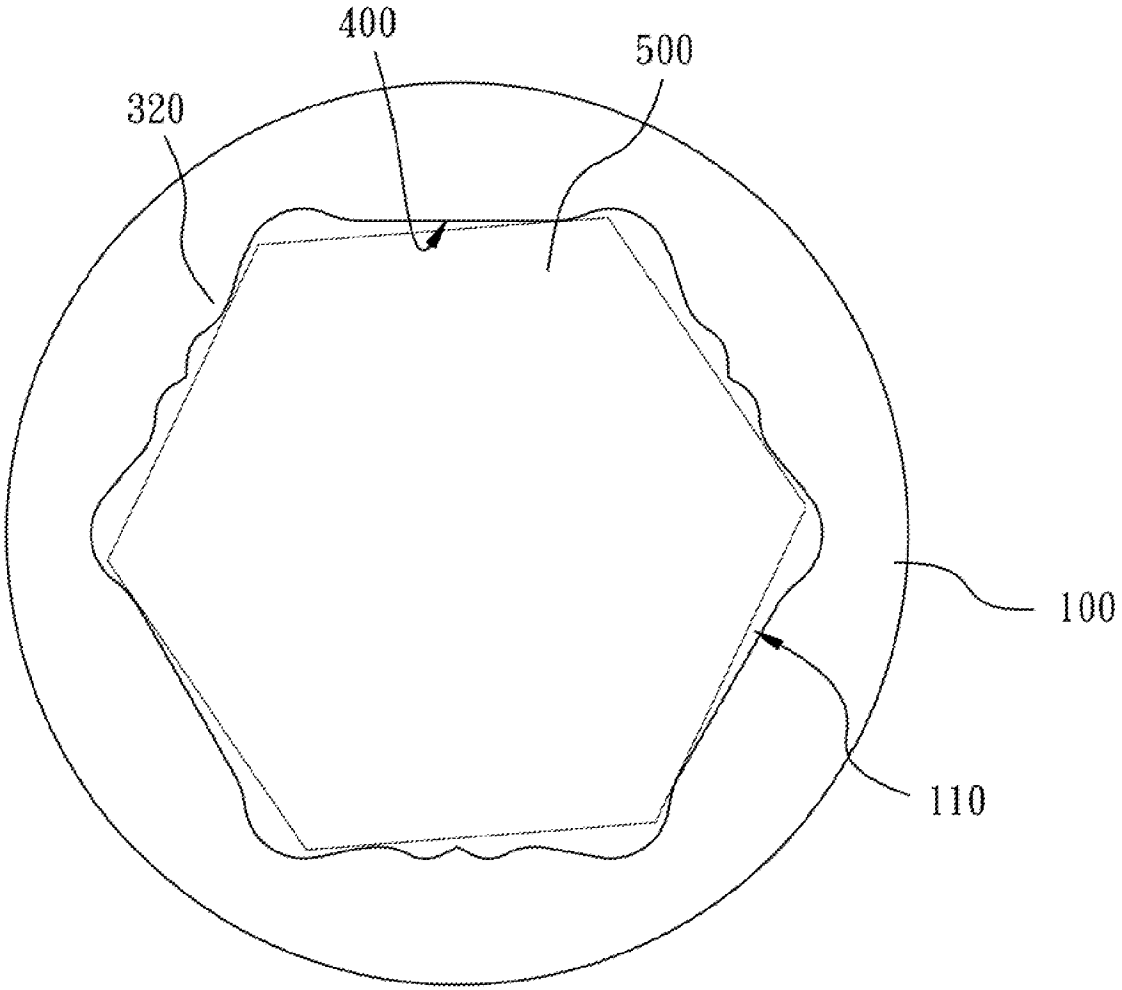
FIG. 3 illustrates the clamping structure of FIG. 1 in one operating mode.
Figure 4:
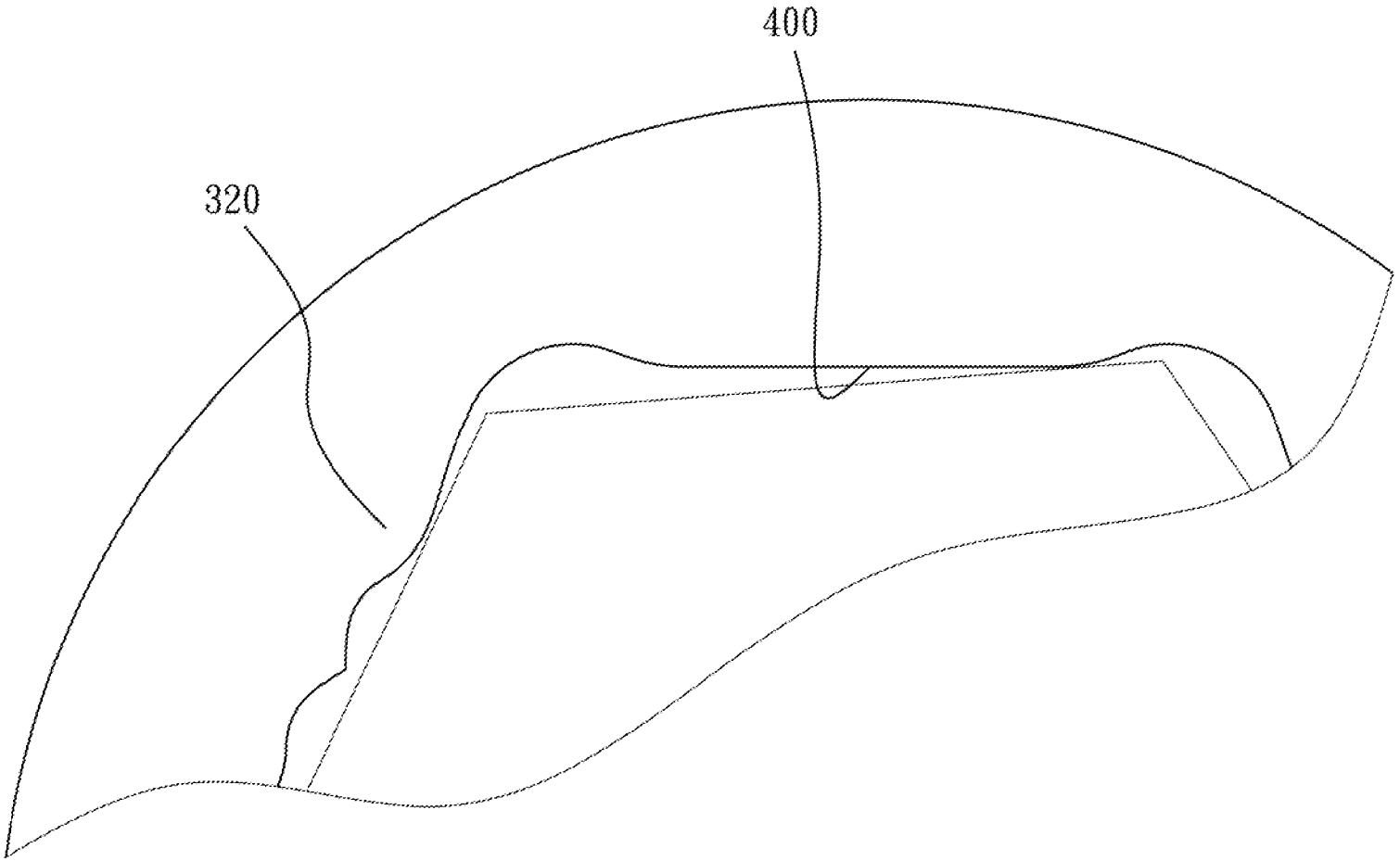
FIG. 4 is a part of the clamping structure of FIG. 3 when the clamping structure rotates a normal nut from an object.

FIG. 3 illustrates the clamping structure of FIG. 1 in one operating mode and FIG. 4 is a partial view f the clamping structure of FIG. 3 when the damping structure rotates a normal nut 500 from an object. In use, the clamping structure of the wrench 100 grips the normal nut 500. The three contact surfaces 400 and the three convex arcs 320 are six actual resistant regions against the wrench 100 for displacing the normal nut 500 rotationally while in use.

Figure 5:
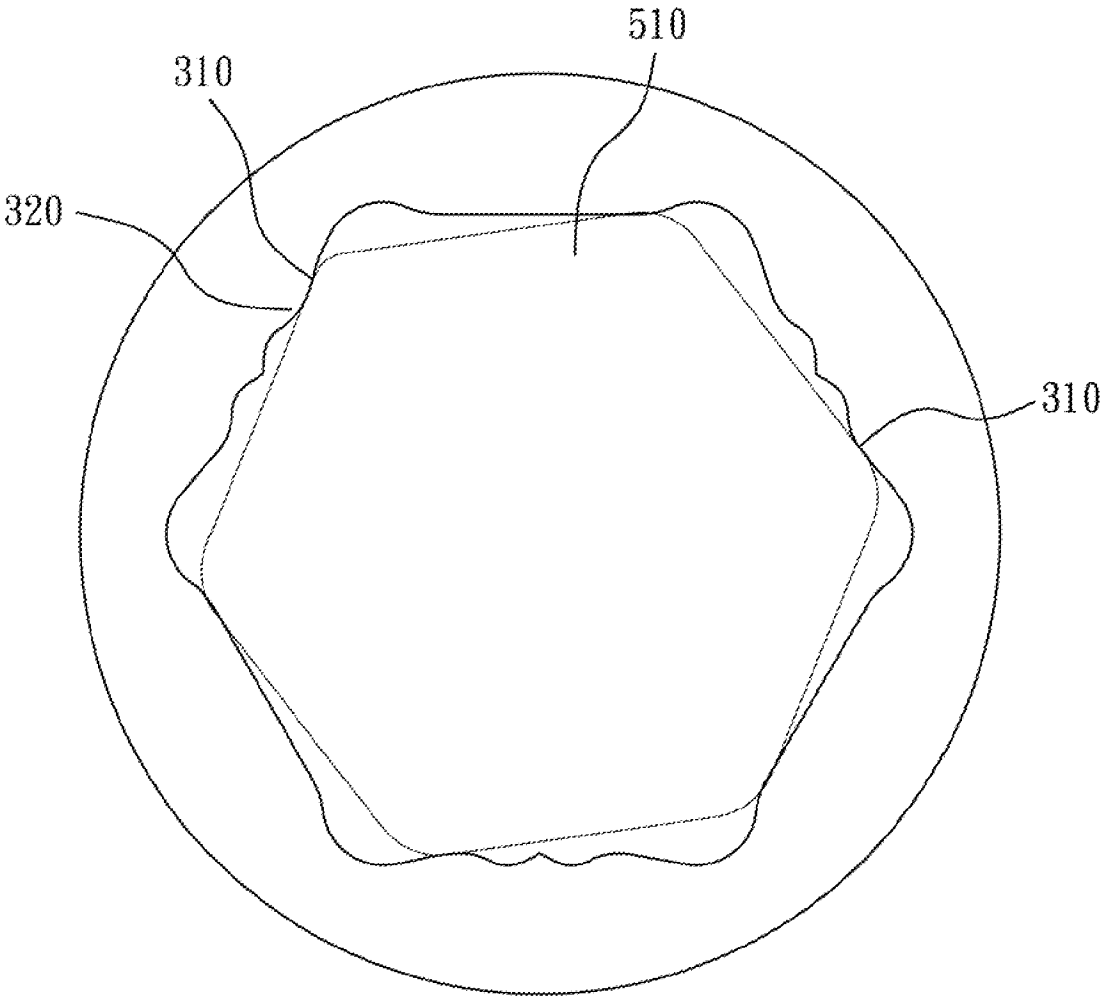
FIG. 5 illustrates the clamping structure of FIG. 1 in another operating mode in which the clamping structure rotates a damaged nut from an object.
Figure 6:
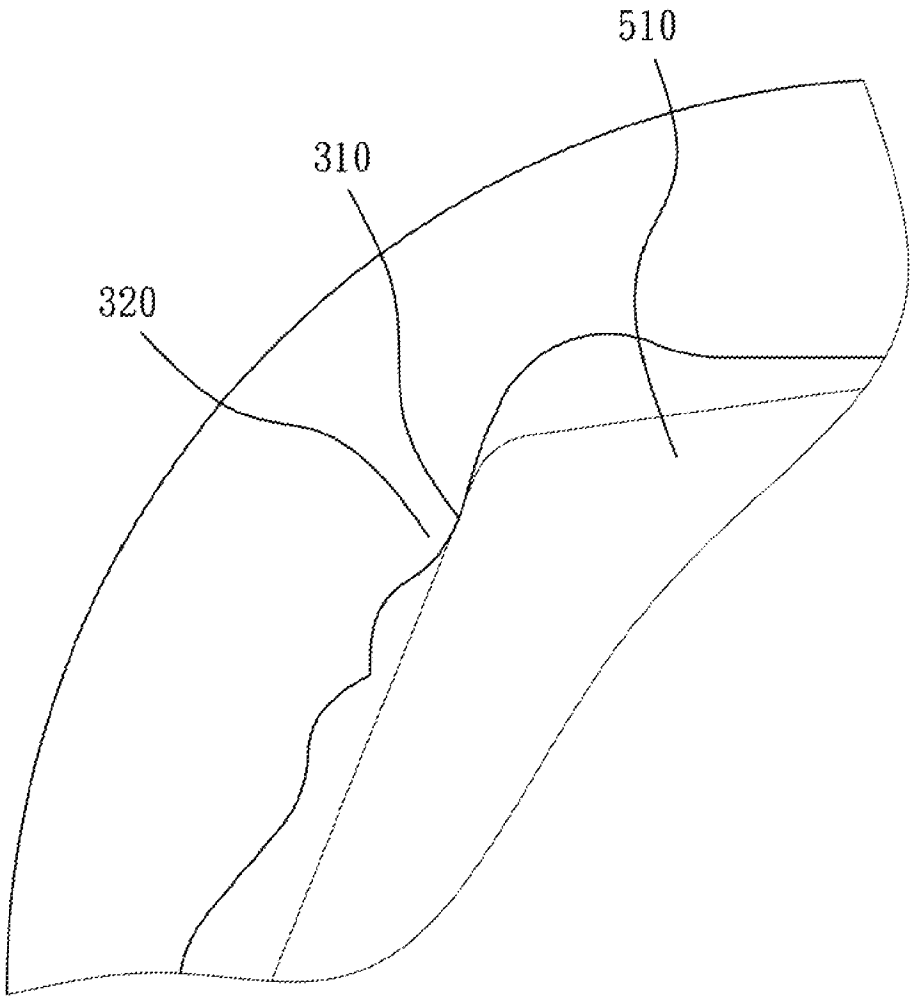
FIG. 6 is a partial view of the clamping structure of FIG. 5 when the clamping structure rotates the damaged nut from the object.

FIG. 5 illustrates the clamping structure of FIG. 1 in another operating mode in which the clamping structure rotates a damaged nut 510 from an object; FIG. 6 is a partial view of the clamping structure of FIG. 5 when the clamping structure rotates the damaged nut 510 from the object. In use, the clamping structure of the wrench 100 grips the damaged nut 510. The inclined planes 310 push the side surface of the damaged nut 510 steadily. Furthermore, each surface of the inclined planes 310 pushes the side surface of the damaged nut 510 to increase the rotational stability between the clamping structure and the nut 510. The convex arc 320 rotates the damaged nut 510 without any sharp prominent structure, and thus the clamping structure will not further increase the degree of damage of the damaged nut 510. In addition to the protective measure mentioned above, the middle salient 340 not further damage the surface of the damaged nut 510 as well.

Figure 7:
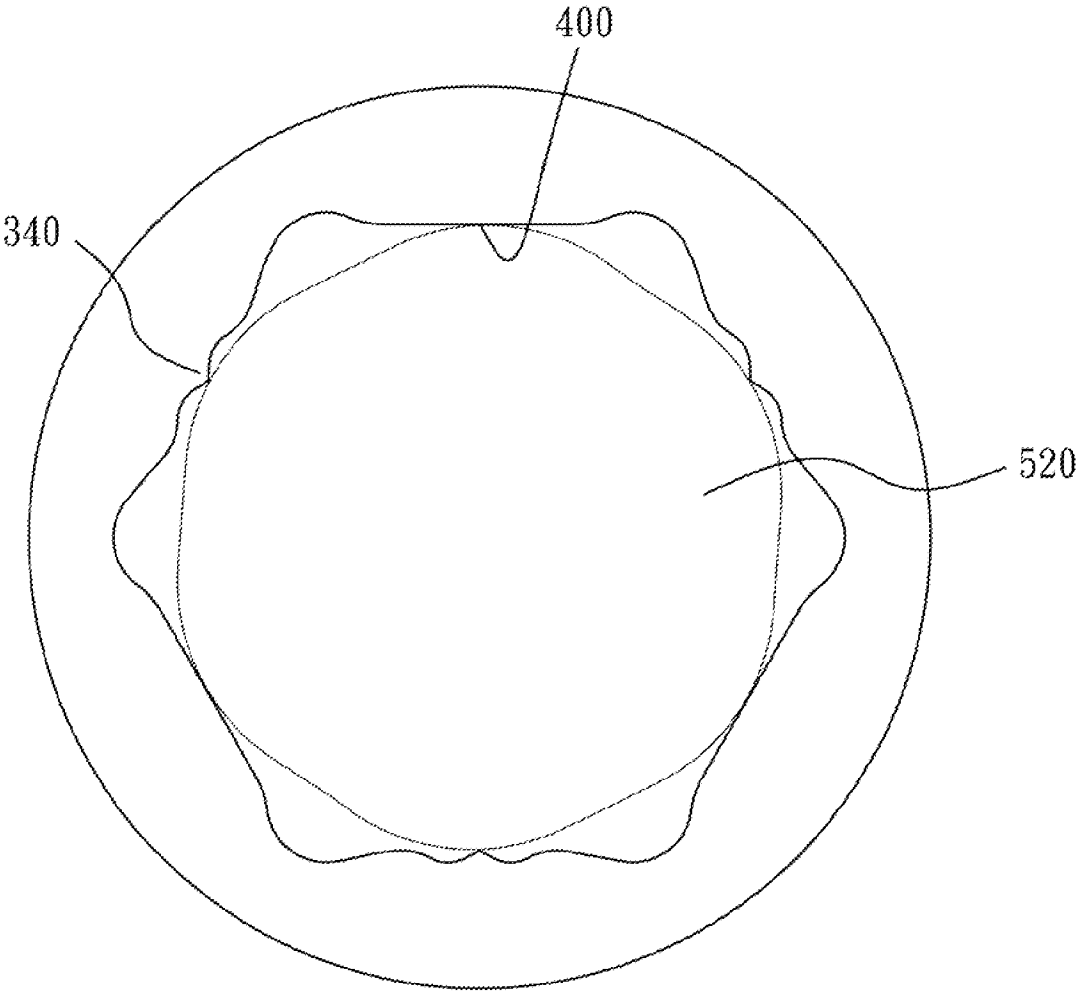
FIG. 7 illustrates the clamping structure of FIG. 1 in another operating mode in which the clamping structure rotates a seriously damaged nut from an object.
Figure 8:
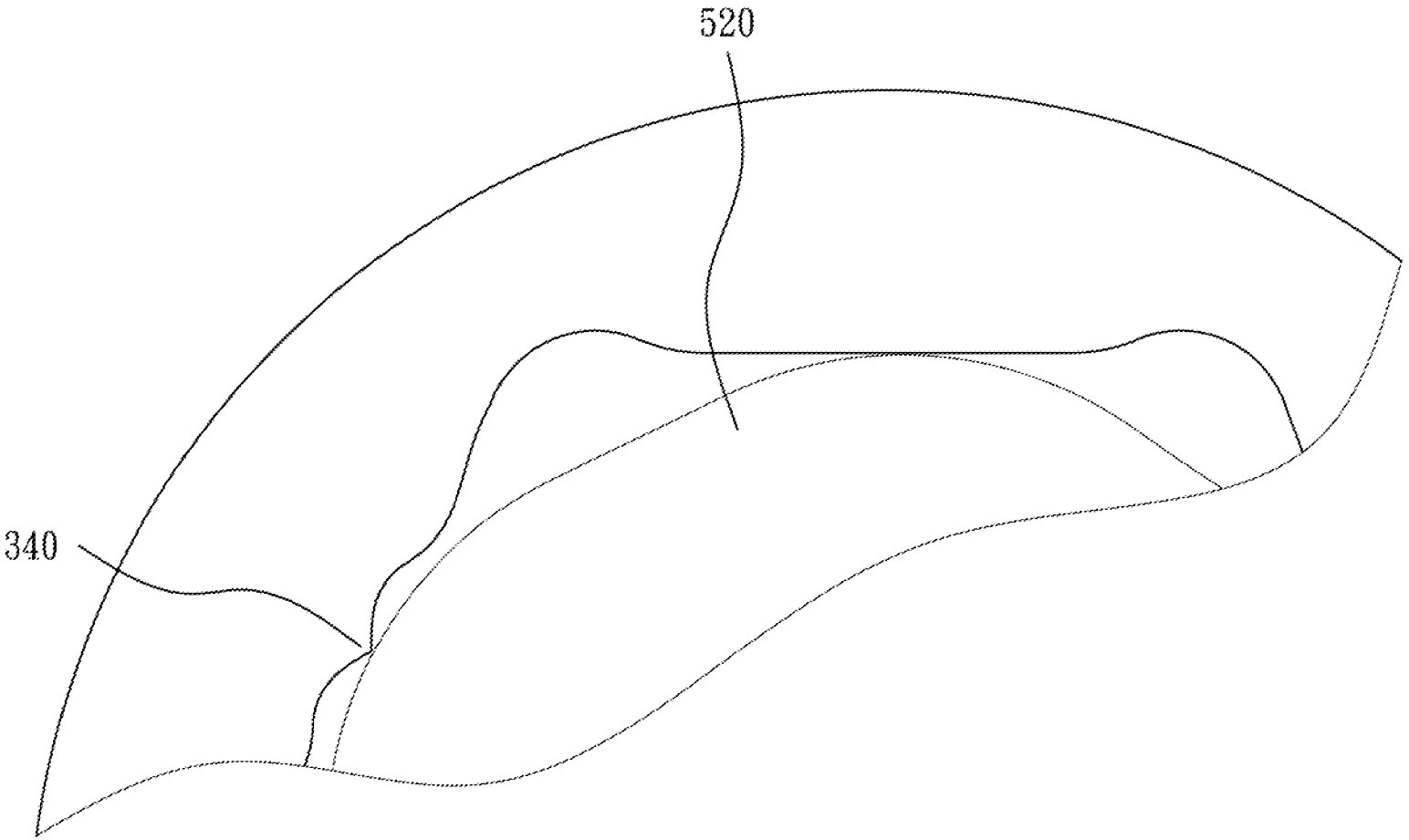
FIG. 8 is a partial view of the clamping structure of FIG. 7 when the clamping structure rotates the seriously damaged nut from the object.

FIG. 7 illustrates the clamping structure of FIG. 1 in another operating mode in which the clamping structure rotates a seriously damaged nut 520 from an object; FIG. 8 is a partial view of the clamping structure of FIG. 7 when the clamping structure rotates the seriously damaged nut 520 from the object. In use, the damping structure of the wrench 100 grips the seriously damaged nut 520. The middle salient 340 grips the seriously damaged nut 520 when the three convex arcs 320 did not reach the seriously damaged nut 520. Therefore, the damping structure of the wrench 100 can rotate the nuts having different damages.

According to one or more embodiments, each of the two convex arcs 320 has a top point 321 and a distance X between the two top points 321. The distance X is one half of a length Z of the inner surface 300. Furthermore, the middle salient 340 has an angular point 341 on a tangent line 342 extending from the two top points 321. Each of the two inclined planes 310 has a length Y of the perpendicular projection of the tangent line 342, and the length Y is smaller than one half of the length Z of the inner surface 300. Therefore, the clamping structure has several actual pushing regions to push a nut or a bolt.

The angle A between a hypothesized extension line 311 of one of the inclined planes 310 and a hypothesized central line 210 of one of the grooves 200 is 40 degrees-50 degrees. Therefore, the angle A of the wrench can be adjusted to devise appropriate specifications for the nuts having different dissimilar damages. Similarly, the angle A is 44 degrees-46 degrees or 45 degrees of some specifications of the nuts having different damages, and the middle salient 340 has an angle B of about 120 degrees. In short, the appropriate specification varies according to the damages of the nuts.

As described above, the present disclosure has the following advantages:

1. High usability: the clamping structure of the wrench 100 can rotate the nuts having different damages.

2. Further damage avoidance: the clamping structure will not further increase the damage of the damaged nut 510. Moreover, the middle salient 340 will not further damage the surface of the damaged nut 510 as well.

All the features disclosed in this specification (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A clamping structure for a wrench, wherein the clamping structure is located in an offset ring of the wrench, and comprises:

a plurality of grooves disposed equidistantly in the Whet ring; and an inner surface located between two grooves, the inner surface comprising, in an order from the grooves to a center of the inner surface:

two inclined planes, wherein an angle between a hypothesized extension line of one of the inclined planes and a hypothesized central line of one of the grooves is 40 degrees-50 degrees;

two convex arcs connected to the inclined planes, wherein the two convex arcs has two top points respectively, and a distance between the two top points is one half of a length of the inner surface;

two concave arcs connected to the inclined planes; and a middle salient connecting one of the concave arcs to the other of the concave arcs.

2. The clamping structure of claim 1, wherein the middle salient has an angular point on a tangent line extending from the two top points.

3. The clamping structure of claim 2, wherein each of the two inclined planes has a length of a perpendicular projection of the tangent line which is smaller than one half of the length of the inner surface.

4. The clamping structure of claim 1, wherein the angle between the hypothesized extension line of the one of the inclined planes and the hypothesized central line of the one of the grooves is 44 degrees-46 degrees.

5. The clamping structure of claim 4, wherein the angle between the hypothesized extension line of the one of the inclined planes and the hypothesized central line of the one of the grooves is 45 degrees.

6. The clamping structure of claim 1, wherein a bottom edge of the two convex arcs and a bottom edge of the two concave arcs are aligned with a hypothesized tangent line.

7. The clamping structure of claim 1, wherein the middle salient has an angle of substantially 120 degrees.

8. The clamping structure of claim 1, wherein the clamping structure has a hexagonal offset ring, and the hexagonal offset ring comprises three non-adjacent inner surfaces and three non-adjacent contact surfaces.

* * * * *